US008280270B2

(12) United States Patent
Morita

(10) Patent No.: US 8,280,270 B2
(45) Date of Patent: Oct. 2, 2012

(54) FIXING DEVICE AND IMAGE FORMING DEVICE

(75) Inventor: Osamu Morita, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 197 days.

(21) Appl. No.: 12/849,287

(22) Filed: Aug. 3, 2010

(65) Prior Publication Data

US 2011/0033197 A1 Feb. 10, 2011

(30) Foreign Application Priority Data

Aug. 5, 2009 (JP) ..... 2009-182608

(51) Int. Cl.
*G03G 15/20* (2006.01)

(52) U.S. Cl. ..... 399/69; 219/216; 399/45

(58) Field of Classification Search ..... 399/69, 399/320, 328, 45; 219/216, 494
See application file for complete search history.

(56) References Cited

U.S. PATENT DOCUMENTS 6,453,130 B1 * 9/2002 Richtsmeier ..... 399/69
2009/0226202 A1 * 9/2009 Kinouchi et al. ..... 399/69

FOREIGN PATENT DOCUMENTS

JP 6-289750 A 10/1994

* cited by examiner

*Primary Examiner* — Sophia S Chen
(74) *Attorney, Agent, or Firm* — Buchanan Ingersoll & Rooney PC

(57) ABSTRACT

A fixing device including a heating roller; a pressure roller forming a nip section by making contact with the heating roller; a controller for controlling the surface temperature of the heating roller so that it becomes a predetermined set temperature; an amount of decrease detector for detecting an amount of decrease in the surface temperature of the pressure roller between before and after the passing of the paper sheet through the nip section; a determiner for specifying a required temperature required to perform the fixing for the paper sheet on the basis of the amount of decrease and for determining whether the set temperature is acceptable as the required temperature; and a temperature compensator for correcting the set temperature so that the set temperature is acceptable as the required temperature in the case that the determiner has determined that the set temperature is not acceptable as the required temperature.

14 Claims, 5 Drawing Sheets

FIXING DEVICE AND IMAGE FORMING DEVICE

CROSS-REFERENCES TO RELATED APPLICATIONS

This application is based on Japanese Patent application No. 2009-182608 filed on Aug. 5, 2009, the contents of which are incorporated herein by reference.

BACKGROUND OF THE INVENTION

1. Field of the Invention

The present invention relates to a fixing device and an image forming device equipped with the fixing device.

2. Description of the Related Art

A fixing device for fixing toner images on paper by heating and pressure application is equipped with a heater having a heat source and a pressurizer disposed so as to make contact with the heater. Fixing is performed for paper by passing the paper through a nip section formed between the heater and the pressurizer. In a heating roller type fixing device, a heating roller is used as the heater, and a pressure roller is used as the pressurizer. The heating roller is heated by the heat source, and the pressure roller is heated by the heating roller.

During the fixing, when paper passes through the nip section, heat is taken from the heating roller and the pressure roller by the paper. The heating roller is made of metal and formed into a cylinder and has a relatively small heat capacity. In addition, the surface temperature of the heating roller is controlled to a predetermined set temperature. Therefore, the problem of the temperature decrease occurred in the heating roller is resolved immediately. On the other hand, the pressure roller is made of rubber and formed into a cylinder and has a relatively large heat capacity. Therefore, the problem of the temperature decrease occurred in the pressure roller is not resolved for a while.

If the temperature of the pressure roller is too low, improper fixing occurs due to insufficient temperature. On the other hand, if the temperature of the pressure roller is too high, offset (paper sticking to the heating roller) or curling (paper bending) occurs due to excessive temperature. For this reason, for the purpose of properly performing fixing for paper, it is necessary to determine the set temperature in consideration of the amount of temperature decrease in the pressure roller. In the following descriptions, the set temperature required to properly perform fixing for paper is referred to as a required temperature. The required temperature is set higher as the amount of temperature decrease is larger so that the amount of temperature decrease is compensated.

The amount of temperature decrease differs depending on a kind of paper. The kinds of paper herein indicate the differences in the thickness (basis weight) and the size of paper. The basis weight is a weight per unit area of paper. Therefore, the required temperature is specified depending on the kind of paper. The required temperature required for A4 size regular paper differs from the required temperature required for A3 size thick paper.

In the case that the kind of paper is changed, the set temperature is required to be changed. The user of an image forming device specifies the kind (basis weight and size) of paper using the operation panel (operation unit) or the like in the image forming device. The fixing device (the image forming device) sets the set temperature on the basis of the specified kind of paper so that the set temperature becomes the required temperature corresponding to the kind of paper.

Japanese Patent Application Laid-open Publication No. 6-289750 (Patent document 1) describes a fixing device equipped with a function of automatically changing the set temperature. The fixing device described in Patent document 1 is a film heating device in which film is used as a heater. In Patent document 1, the set temperature of the film is changed automatically by detecting the temperature decrease speed (temperature change per unit time) after the end of printing. The temperature decrease speed (the degree of ease to cool) of the film changes depending on the temperature environment of the fixing device. In other words, the set temperature is changed depending on the degree of ease to cool the film.

In the above-mentioned conventional fixing device, the set temperature is set on the basis of the kind of paper specified using the operation panel. Therefore, in the case that the user has specified an incorrect kind, that is, in the case that the specified kind differs from the kind of paper actually set inside the image forming device, the set temperature becomes different from the required temperature of the actual paper. As a result, improperly printed paper is generated due to insufficient or excessive temperature. The printed paper is herein defined as paper on which printing is performed.

SUMMARY OF THE INVENTION

A first aspect of the present invention provides a fixing device described below, comprising a heater; a pressurizer forming a nip section by making contact with the heater so that fixing is performed for a sheet passing through the nip section; a controller for controlling the surface temperature of the heater so that the surface temperature of the heater becomes a predetermined set temperature; an amount of decrease detector for detecting an amount of decrease in the surface temperature of the pressurizer between before and after the passing of the sheet through the nip section; a determiner for specifying a required temperature required to perform the fixing for the sheet on the basis of the amount of decrease and for determining whether the set temperature is acceptable as the required temperature; and a temperature compensator for correcting the set temperature so that the set temperature is acceptable as the required temperature in the case that the determiner has determined that the set temperature is not acceptable as the required temperature.

A second aspect of the present invention provides an image forming device described below, comprising a heater; a pressurizer, forming a nip section by making contact with the heater so that fixing of a image is performed for the sheet passing through the nip section; a controller for controlling the surface temperature of the heater so that the surface temperature of the heater becomes a predetermined set temperature; an amount of decrease detector for detecting an amount of decrease in the surface temperature of the pressurizer between before and after the passing of the sheet through the nip section; a determiner for specifying a required temperature required to perform the fixing for the sheet on the basis of the amount of decrease and for determining whether the set temperature is acceptable as the required temperature; and a temperature compensator for correcting the set temperature so that the set temperature is acceptable as the required temperature in the case that the determiner has determined that the set temperature is not acceptable as the required temperature.

DETAILED DESCRIPTION OF THE INVENTION

First Embodiment

Figure 1:
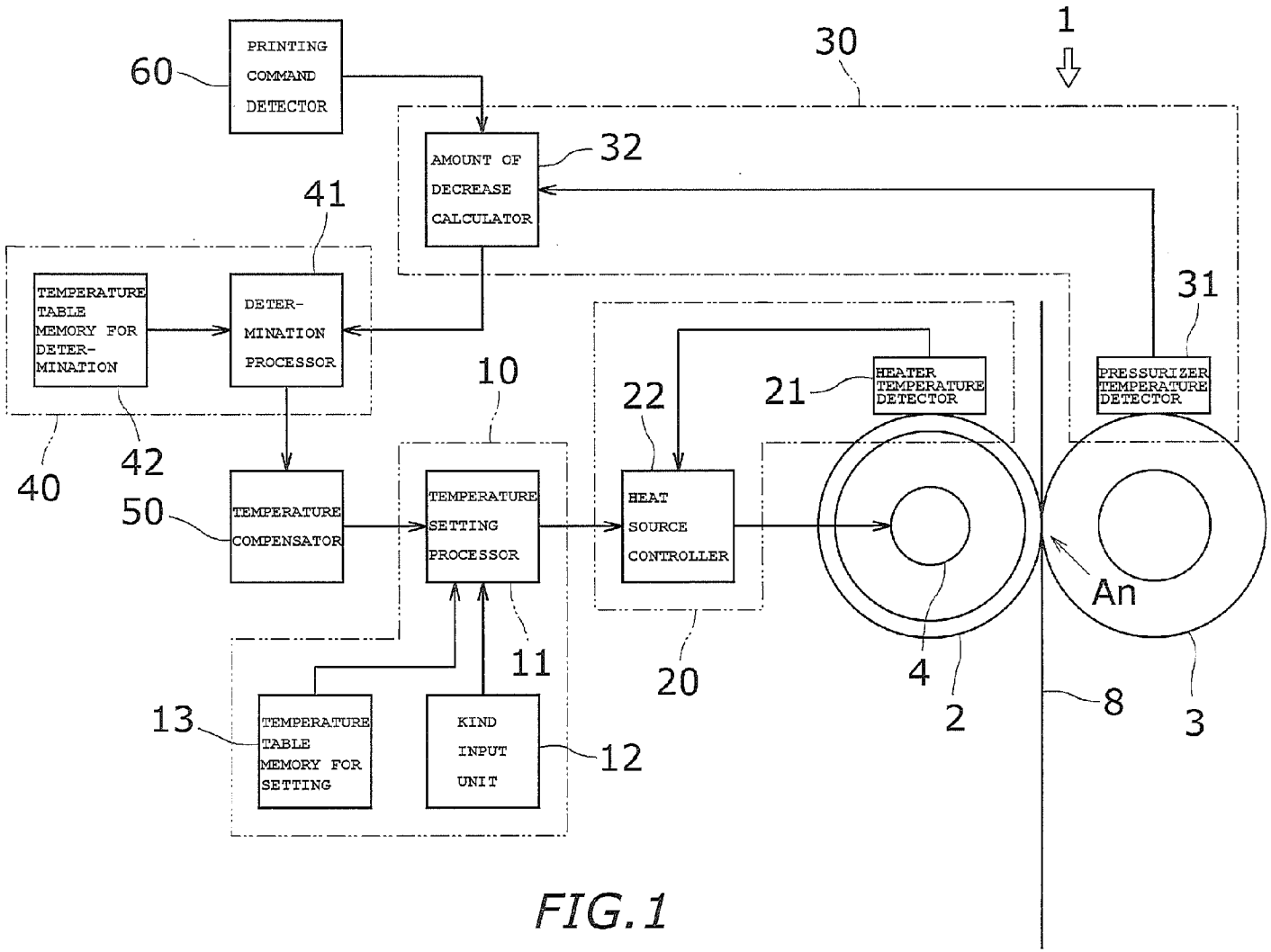
FIG. 1 is a schematic view showing the configuration of a fixing device (a first embodiment).

FIG. 1 is a schematic view showing the configuration of a fixing device 1 according to a first embodiment. The fixing device 1 is disposed inside an image forming device. Referring to FIG. 1, the fixing device 1 is equipped with a heating roller (heater) 2, a pressure roller (pressurizer) 3, a heat source 4, a temperature setter 10, a heater temperature controller 20, an amount of decrease detector 30, a determiner 40, a temperature compensator 50 and a printing command detector 60.

A nip section An is a portion located between the heating roller 2 and a pressure roller 3. A paper sheet 8 is conveyed so as to pass through the nip section An. The paper sheet 8 is heated and pressed while passing through the nip section An. As a result, toner images transferred onto the paper sheet 8 are fixed onto the paper sheet 8.

The heat source 4 is a halogen heater. The heat source 4 is disposed inside the heating roller 2 and heats the heating roller 2.

The pressure roller 3 is disposed so as to make contact with the heating roller 2. Therefore, the pressure roller 3 is heated by the heating roller 2.

The temperature setter 10 sets a control target value in the surface temperature of the heating roller 2. The control target value set by the temperature setter 10 is hereafter referred to as a set temperature. The temperature setter 10 is equipped with a temperature setting processor 11, a kind input unit 12 and a temperature table memory for setting 13.

TABLE 1 is a correspondence table (temperature table for setting) showing the correspondence between the kinds and the required temperatures. The temperature table memory for setting 13 memorizes the temperature table for setting of TABLE 1.

TABLE 1

| | Size | | |
|---|---|---|---|
| Kind | A3 | A4 | A5 |
| Regular paper (64~90 g/m$^2$) | T3 (190 deg C.) | T1 (170 deg C.) | T1 (170 deg C.) |
| Thick paper A (91~127 g/m$^2$) | T3 (190 deg C.) | T2 (180 deg C.) | T1 (170 deg C.) |
| Thick paper B (127~157 g/m$^2$) | T4 (200 deg C.) | T3 (190 deg C.) | T2 (180 deg C.) |

In the temperature table for setting of TABLE 1, a required temperature is set for each kinds of paper. The kinds of paper indicate the difference in the thickness (basis weight) and the size of paper. The basis weight is a weight per unit area of paper. The required temperature is the surface temperature of the heating roller 2 that is required to perform the fixing for paper. Regular paper, thick paper A and thick paper B are available depending on the difference in thickness. Furthermore, forms A3, A4 and A5 are available depending on the difference in size. A3, etc. indicate the sizes specified in the JIS standard. Nine kinds of paper are available in combination of three different thicknesses and three different sizes in the temperature table for setting of TABLE 1. First fixing temperature T1, second fixing temperature T2, third fixing temperature T3 and fourth fixing temperature T4 are available as required temperatures. The fixing temperatures T1, T2, T3 and T4 are 170° C., 180° C., 190° C. and 200° C., respectively, for example. The required temperature in each kind is set to any one of the four fixing temperatures.

The kind input unit 12 is a device for inputting the kinds of paper. The kind input unit 12 is provided in the operation unit of the image forming device, for example. The user of the image forming device can set the kind of paper to be printed, by operating the operation unit. The user can set one of the kinds: the regular paper, thick paper A and thick paper B, for example, according to the thickness of paper. In addition, the user can also set one of the forms A3, A4 and A5 according to the size of paper.

The temperature setting processor 11 sets the required temperature which corresponds to the input kind to the set temperature on the basis of the temperature table for setting of TABLE 1.

The heater temperature controller 20 controls the heat source 4 inside the heating roller 2 so that the surface temperature of the heating roller 2 becomes a predetermined set temperature. The heater temperature controller 20 is equipped with a heater temperature detector 21 and a heat source controller 22.

The heater temperature detector 21 detects the surface temperature of the heating roller 2. In the following descriptions, the heater temperature indicates the surface temperature of the heating roller 2. The heater temperature detector 21 is a thermistor or a thermopile, for example.

The heat source controller 22 controls the heat source 4 so that the heater temperature detected by the heater temperature detector 21 coincides with the set temperature set by the temperature setting processor 11.

The amount of decrease detector 30 detects an amount of decrease in the surface temperature of the pressure roller 3 between before and after the passing of the paper sheet 8 through the nip section An. The amount of decrease detector 30 is equipped with a pressurizer temperature detector 31 and an amount of decrease calculator 32.

The pressurizer temperature detector 31 detects the surface temperature of the pressure roller 3. In the following descriptions, the pressurizer temperature indicates the surface temperature of the pressure roller 3. The pressurizer temperature detector 31 is a temperature detector that detects the temperature of the pressurizer by making contact with the surface of the pressure roller 3. The pressurizer temperature detector 31 is a thermistor, for example.

The amount of decrease calculator 32 calculates the amount of decrease in the pressurizer temperature between before and after the passing of the paper sheet 8 on the basis of the change in the pressurizer temperature detected by the pressurizer temperature detector 31.

The determiner 40 specifies the required temperature on the basis of the amount of decrease and determines whether the set temperature is acceptable as the required temperature.

The determiner 40 is equipped with a determination processor 41 and a temperature table memory for determination 42.

TABLE 2 is a correspondence table (temperature table for determination) showing the correspondence between the amount of decrease and the required temperature. The temperature table memory for determination 42 memorizes the temperature table for determination of TABLE 2.

TABLE 2

| Range of temperature amount of decrease | Required temperature | |
|---|---|---|
| R1 (0~12 deg C.) | T1 (170 deg C.) | A4 Regular paper (64~90 g/m$^2$) |
| R2 (12~18 deg C.) | T2 (180 deg C.) | A4 Thick paper A (91~127 g/m$^2$) |
| R3 (18~35 deg C.) | T3 (190 deg C.) | A4 Thick paper B (127~157 g/m$^2$) |
| R4 (35 deg C.) | T4 (200 deg C.) | |

In the temperature table for determination of TABLE 2, the required temperature is set for each predetermined range of the amount of decrease. A first range R1, a second range R2, a third range R3 and a fourth range R4 are available as the predetermined ranges of the amount of decrease. Fixing temperatures T1, T2, T3 and T4 are available as the required temperature, as described above. In Table 2, the ranges R1, R2, R3 and R4 correspond to the fixing temperatures T1, T2, T3 and T4, respectively. The ranges R1, R2, R3 and R4 are 0 to 12° C., 12 to 18° C., 18 to 35° C., and 35° C. or more, for example. According to the temperature table for determination of TABLE 2, the required temperature is higher as the amount of decrease is larger. The correspondence between the amount of decrease and the thickness of A4 size paper is provided on the right side of TABLE 2 as reference.

The determination processor 41 first specifies the required temperature on the basis of the amount of decrease calculated by the amount of decrease calculator 32 and the temperature table for determination of TABLE 2.

Next, the determination processor 41 determines whether the set temperature is acceptable as the required temperature. In the case that the difference between the set temperature and the required temperature is less than a predetermined value, the set temperature corresponds to the temperature that is acceptable as the required temperature. In this embodiment, only when the set temperature coincides with the required temperature, the set temperature corresponds to the temperature that is acceptable as the required temperature. In this case, since the set temperature is appropriate, the set temperature is maintained. On the other hand, when the set temperature does not coincide with the required temperature, the set temperature does not correspond to the temperature that is acceptable as the required temperature. In this case, the set temperature is required to be corrected to a temperature that is acceptable as the required temperature.

In the case that the determination result of the determiner 40 is negative, the temperature compensator 50 corrects the set temperature so that the set temperature becomes a temperature that is acceptable as the required temperature. In this embodiment, the set temperature is corrected so as to coincide with the required temperature. For example, when the set temperature is 170° C. and the required temperature is 180° C., the set temperature is corrected from 170° C. to 180° C. Here, the temperature compensator 50 corrects the set temperature of the temperature setting processor 11. When the set temperature is corrected, the heater temperature controller 20 controls the heater temperature on the basis of the corrected set temperature. In the case that the determination result of the determiner 40 is affirmative, the set temperature is maintained.

The printing command detector 60 detects whether a printing command input to the image forming device equipped with the fixing device 1 is present. The printing command is a command for printing the paper sheet 8. Not only a single printing command for printing one paper sheet but also a continuous printing command for printing two or more paper sheets is available as a printing command.

The operation of the fixing device 1 according to the first embodiment will be described below.

The image forming device operates the devices in charge of performing each process of image formation on the basis of the printing command. The fixing device 1 is one of the devices in charge of performing each process of image formation and performs fixing.

Figure 7:
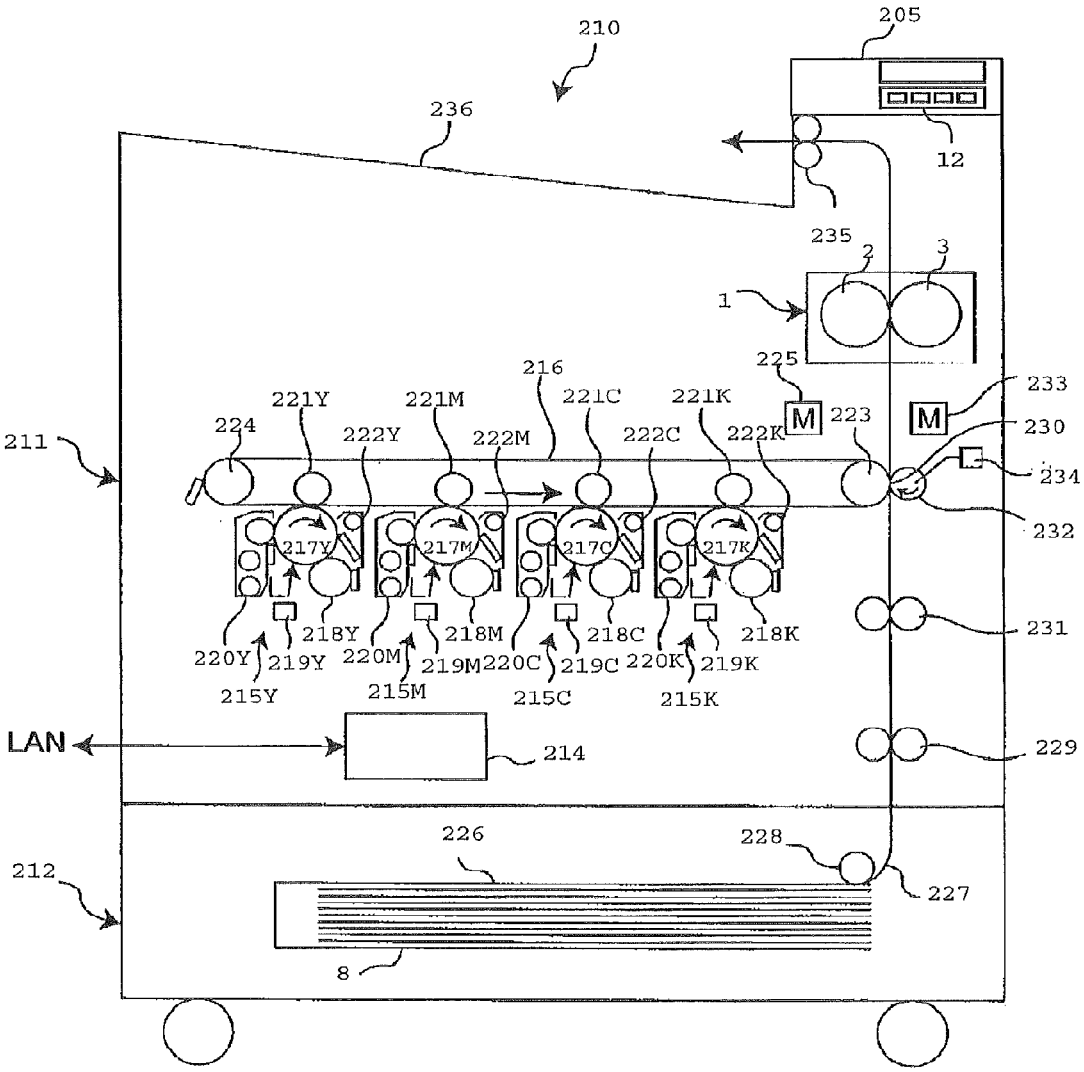
FIG. 7 is a view showing the configuration of an image forming device equipped with the fixing device according to the first/second embodiment.

The user of the image forming device sets the kind (thickness and size) of paper using an operation unit 205 (see FIG. 7). The set temperature is set to the required temperature corresponding to the input kind by the temperature setter 10. On the basis of the printing command, the fixing device 1 raises the heater temperature from a waiting temperature at a waiting time to the set temperature based on the printing command. The waiting temperature is 120° C., for example, and the waiting temperature is lower than the first fixing temperature T1 that is the lowest temperature among the fixing temperatures T1 to T4.

Figure 2:
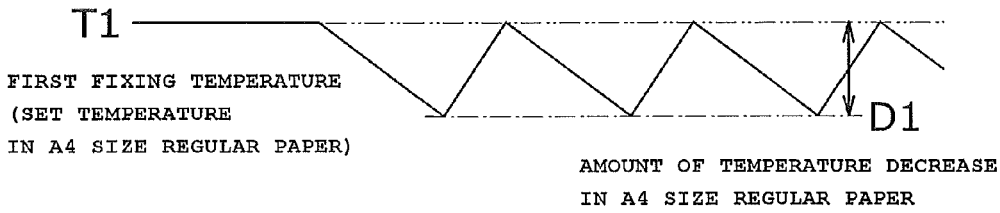
FIG. 2 is a graph showing the temporal change in pressurizer temperature under the conditions that a first fixing temperature is set and that A4 size regular paper is printed.

FIG. 2 is a graph showing the temporal change in pressurizer temperature under the conditions that the first fixing temperature T1 is set and that A4 size regular paper is printed.

In FIG. 2, the set temperature is set to the first fixing temperature T1 on the basis of the input kind. More specifically, A4 size regular paper is input as a kind. Therefore, the heater temperature is maintained at the first fixing temperature T1. Since the pressure roller 3 makes contact with the heating roller 2, the pressurizer temperature becomes close to the heater temperature. As a result, the pressurizer temperature and the heater temperature are maintained at the first fixing temperature T1. In FIG. 2, the pressurizer temperature is maintained at the first fixing temperature T1 until the paper sheet 8 passes through the nip section An on the basis of the printing command.

In FIG. 2, the pressurizer temperature repeats lowering and rising periodically. When the paper sheet 8 has passed through the nip section An, heat is taken from the heating roller 2 and the pressure roller 3 by the paper sheet 8. Therefore, the pressurizer temperature lowers while the paper sheet 8 passes through the nip section An. On the other hand, when the paper sheet 8 is not at the nip section An, heat is not taken from the heating roller 2 and the pressure roller 3. Therefore, the pressurizer temperature rises between after the passing of one paper sheet and before the passing of the next paper sheet. The pressurizer temperature thus lowers and rises when one paper sheet passes through the nip section An. In other words, one cycle of lowering and rising corresponds to the fixing of one paper sheet. Furthermore, FIG. 2 shows an amount of decrease D1 in one paper sheet. The amount of decrease D1 is 10° C., for example. The amount of decrease D1 in the first to third paper sheets are approximately the same.

In FIG. 1, the input of the printing command is detected by the printing command detector 60. The amount of decrease detector 30 detects the amount of decrease D1 in the paper sheet 8 on the basis of the printing command. In the case that the continuous printing command is input as shown in FIG. 2, the determiner 40 performs determination only for the first paper sheet of a plurality of paper sheets that are printed on the basis of the continuous printing command. The set temperature is maintained or corrected on the basis of the determination result obtained for the first paper sheet.

In the situation shown in FIG. 2, the amount of decrease D1 (10° C.) in the first paper sheet corresponds to the first fixing temperature T1 in reference to the temperature table for determination of TABLE 2. In the situation shown in FIG. 2, the required temperature of the paper sheet 8 is the first fixing temperature T1.

The determiner 40 determines whether the set temperature is acceptable as the required temperature. The set temperature is the first fixing temperature T1, and the required temperature is also the first fixing temperature T1. Since the set temperature coincides with the required temperature, the determination result of the determiner 40 is affirmative. Therefore, the set temperature is maintained at the first fixing temperature T1. As a result, fixing is performed for the second and subsequent paper sheets that are printed on the basis of the continuous printing command while the set temperature is maintained at the first fixing temperature T1.

Figure 3:
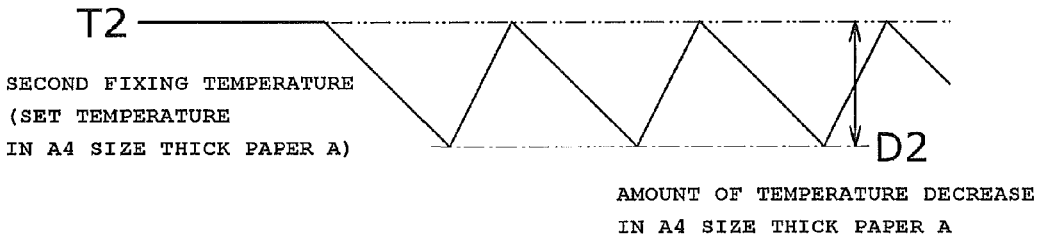
FIG. 3 is a graph showing the temporal change in pressurizer temperature under the conditions that a second fixing temperature is set and that A4 size thick paper A is printed.

FIG. 3 is a graph showing the temporal change in pressurizer temperature under the conditions that the second fixing temperature T2 is set and that A4 size thick paper A is printed. FIG. 3 shows an amount of decrease D2 in one paper sheet. The amount of decrease D2 is 15° C., for example. The amount of decrease D2 in the first to third paper sheets are approximately the same.

In the situation shown in FIG. 3, the amount of decrease D2 (15° C.) in the first paper sheet corresponds to the second fixing temperature T2 in reference to the temperature table for determination of TABLE 2. In the situation shown in FIG. 3, the required temperature of the paper sheet 8 is the second fixing temperature T2.

The determiner 40 determines whether the set temperature is acceptable as the required temperature. The set temperature is the second fixing temperature T2, and the required temperature is also the second fixing temperature T2. Since the set temperature coincides with the required temperature, the determination result of the determiner 40 is affirmative. Therefore, the set temperature is maintained at the second fixing temperature T2. As a result, fixing is performed for the second and subsequent paper sheets that are printed on the basis of the continuous printing command while the set temperature is maintained at the second fixing temperature T2.

In each of the situations shown in FIGS. 2 and 3, the kind of paper set by the user coincides with the kind of paper to be printed actually. In the situation, since the set temperature is matched with the kind of paper, the set temperature is not corrected.

Figure 4:
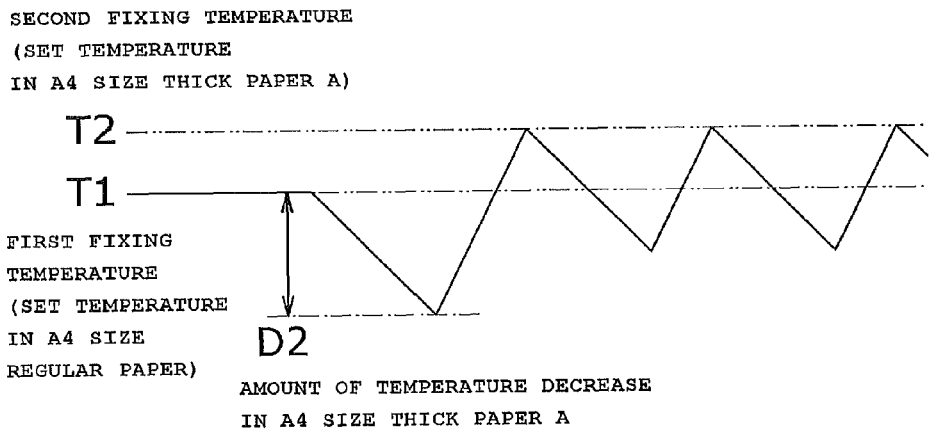
FIG. 4 is a graph showing the temporal change in pressurizer temperature under the conditions that the first fixing temperature is set and that A4 size thick paper A is printed.

FIG. 4 is a graph showing the temporal change in pressurizer temperature under the conditions that the first fixing temperature T1 is set and that A4 size thick paper A is printed. FIG. 4 shows the amount of decrease D2 in one paper sheet. The amount of decrease D2 is 15° C., for example. The amount of decrease D2 in the first to third paper sheets are approximately the same.

In the situation shown in FIG. 4, the amount of decrease D2 (15° C.) in the first paper sheet corresponds to the second fixing temperature T2 in reference to the temperature table for determination of TABLE 2. In the situation shown in FIG. 4, the required temperature of the paper sheet 8 is the second fixing temperature T2.

The determiner 40 determines whether the set temperature is acceptable as the required temperature. The set temperature is the first fixing temperature T1, but the required temperature is the second fixing temperature T2. Since the set temperature does not coincide with the required temperature, the determination result of the determiner 40 is negative. Therefore, the set temperature is corrected from the first fixing temperature T1 to the second fixing temperature T2. As a result, fixing is performed for the second and subsequent paper sheets that are printed on the basis of the continuous printing command while the set temperature is maintained at the second fixing temperature T2.

Figure 5:
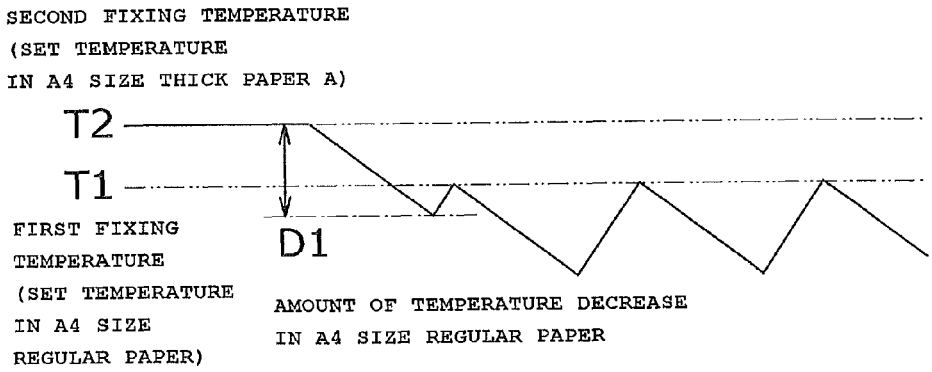
FIG. 5 is a graph showing the temporal change in pressurizer temperature under the conditions that the second fixing temperature is set and that A4 size regular paper is printed.

FIG. 5 is a graph showing the temporal change in pressurizer temperature under the conditions that the second fixing temperature T2 is set and that A4 size regular paper is printed. FIG. 5 shows the amount of decrease D1 in one paper sheet. The amount of decrease D1 is 10° C., for example. The amount of decrease D1 in the first to third paper sheets are approximately the same.

In the situation shown in FIG. 5, the amount of decrease D1 (10° C.) in the first paper sheet corresponds to the first fixing temperature T1 in reference to the temperature table for determination of TABLE 2. In the situation shown in FIG. 5, the required temperature of the paper sheet 8 is the first fixing temperature T1.

The determiner 40 determines whether the set temperature is acceptable as the required temperature. The set temperature is the second fixing temperature T2, but the required temperature is the first fixing temperature T1. Since the set temperature does not coincide with the required temperature, the determination result of the determiner 40 is negative. Therefore, the set temperature is corrected from the second fixing temperature T2 to the first fixing temperature T1. As a result, fixing is performed for the second and subsequent paper sheets that are printed on the basis of the continuous printing command while the set temperature is maintained at the first fixing temperature T1.

In each of the situations shown in FIGS. 4 and 5, the kind of paper set by the user differs from the kind of paper to be printed actually. In the situation, since the set temperature is not matched with the kind of paper, the set temperature is corrected. The set temperature is matched with the kind of paper by virtue of the correction.

The fixing device according to the first embodiment can specify the required temperature of the paper and correct the set temperature of the paper to the required temperature. Therefore, the occurrence of improperly printed paper is suppressed.

Second Embodiment

Next, a fixing device 1 according to a second embodiment will be described below. The components of the fixing device 1 according to the second embodiment are partly different from those according to the first embodiment. The components according to the second embodiment common to those according to the first embodiment are designated by the same reference signs.

Figure 6:
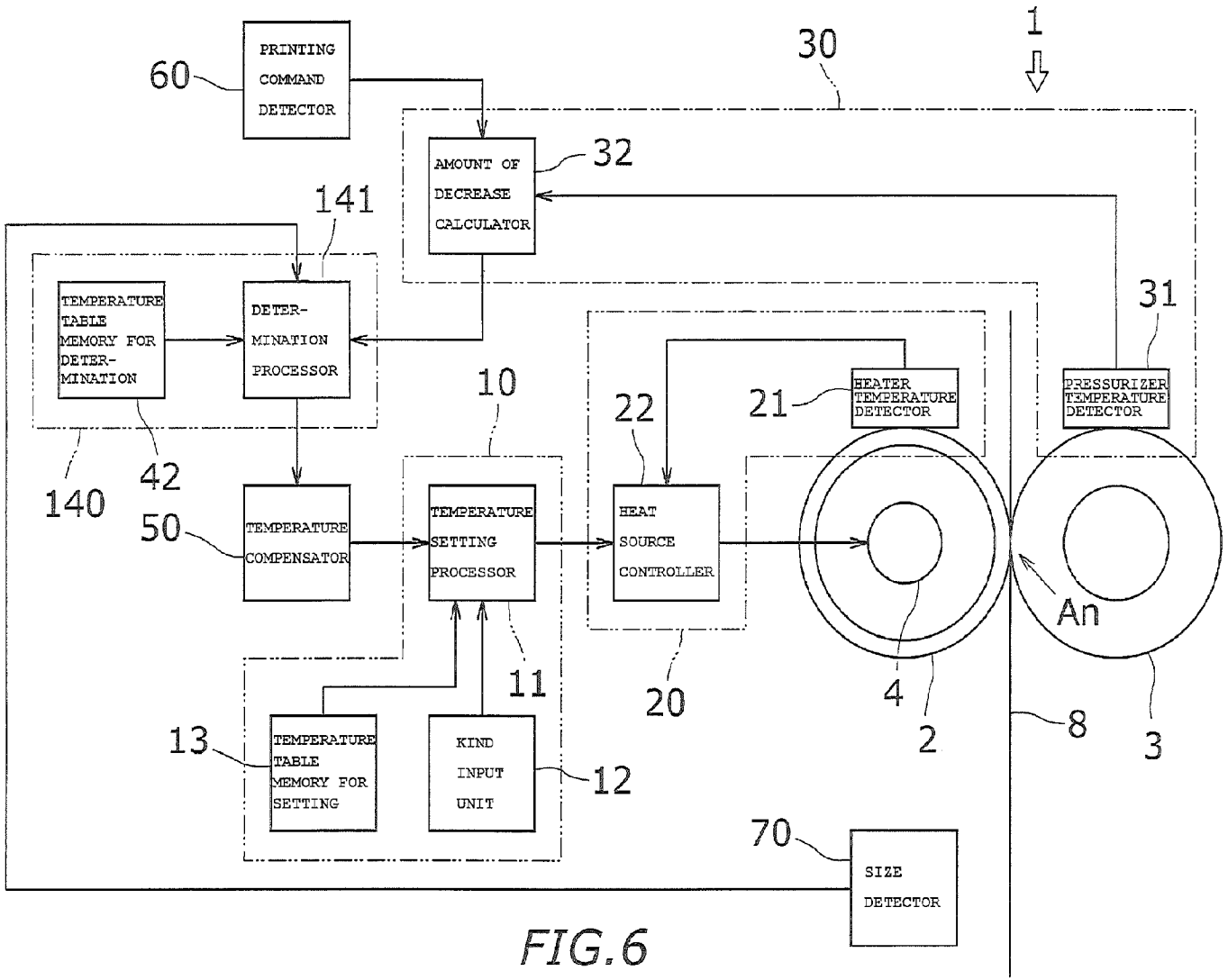
FIG. 6 is a schematic view showing the configuration of a fixing device (a second embodiment).

FIG. 6 is a schematic view showing the configuration of the fixing device 1 according to the second embodiment. The fixing device 1 is disposed inside an image forming device. Referring to FIG. 6, the fixing device 1 is equipped with a heating roller (heater) 2, a pressure roller (pressurizer) 3, a heat source 4, a temperature setter 10, a heater temperature controller 20, an amount of decrease detector 30, a determiner 140, a temperature compensator 50, a printing command detector 60 and a size detector 70.

The configuration of the second embodiment differs from that of the first embodiment in the following points. The determiner 140 is used instead of the determiner 40 of the first embodiment. The fixing device 1 is additionally equipped with the size detector 70. Instead of the temperature table for determination of TABLE 2, a temperature table for determination of TABLE 3 is memorized in the temperature table memory for determination 42. In the following descriptions, the portions relating to the different points will be mainly described below.

The size detector 70 detects the size of the paper sheet 8. The size indicates the size of the paper sheet specified by the height and width thereof. The size detector 70 is disposed at the starting end and/or at the middle of the paper conveyance path in the image forming device, for example.

The determiner 140 specifies the required temperature on the basis of not only the amount of decrease but also the size and determines whether the set temperature is acceptable as the required temperature. The determiner 140 is equipped with a determination processor 141 and a temperature table memory for determination 42.

The determination processor 141 specifies the required temperature on the basis of the amount of decrease calculated by the amount of decrease calculator 32, the size of the paper sheet 8 detected by the size detector 70, and the temperature table for determination of TABLE 3. Next, the determination processor 141 determines whether the set temperature is acceptable as the required temperature.

TABLE 3 is a correspondence table (temperature table for determination) showing the correspondence between the amount of decrease and the required temperature.

TABLE 3

| | Size | | |
|---|---|---|---|
| Kind | A3 | A4 | A5 |
| Regular paper | R11(0~27 deg C.) | R12(0~12 deg C.) | R13(0~10 deg C.) |
| (64~90 g/m$^2$) | T3 (190 deg C.) | T1 (170 deg C.) | T1 (170 deg C.) |
| Thick paper A | R21(27~35 deg C.) | R22(12~18 deg C.) | R23(10~15 deg C.) |
| (91~127 g/m$^2$) | T3 (190 deg C.) | T2 (180 deg C.) | T1 (170 deg C.) |
| Thick paper B | R31(35 deg C.~) | R32(18 deg C.~) | R33(15 deg C.~) |
| (127~157 g/m$^2$) | T4 (200 deg C.) | T3 (190 deg C.) | T2 (180 deg C.) |

In the temperature table for determination of TABLE 3, the required temperature is set for each predetermined range of the amount of decrease. The predetermined range of the amount of decrease is set for each kinds of paper. Nine kinds of paper are available in combination of three different thicknesses and three different sizes. Therefore, nine ranges are available as the predetermined ranges of the amount of decrease. The predetermined ranges of the amount of decrease are an 11th range R11, a 12th range R12, a 13th range R13, a 21st range R21, a 22nd range R22, a 23rd range R23, a 31st range R31, a 32nd range R32 and a 33rd range R33. Fixing temperatures T1, T2, T3 and T4 are available as the required temperatures. In Table 3, the required temperature in each of the nine ranges R11 to R33 is set to any one of the required temperatures T1, T2, T3 and T4.

The operation of the fixing device 1 according to the second embodiment will be described. The operation of the determiner 140 of the second embodiment, different from the operation of the determiner 40 according to the first embodiment, will be mainly described below.

The operation will be described referring to FIG. 4. In the situation shown in FIG. 4, the first fixing temperature T1 is set and A4 size thick paper A is printed. The amount of decrease D2 is 15° C., for example. In the situation shown in FIG. 4, referring to the temperature table for determination of TABLE 3, the range R22 is the range corresponding to the amount of decrease D2=15° C. and the size=A4 size. Here, except for the range R22 (12 to 18° C.), the range R11 (0 to 27° C.) and the range R33 (15° C. or more) are the ranges corresponding to the amount of decrease D2=15° C. Even if the amounts of decrease are the same, if the ranges are different, the required temperatures may become different in, some cases. The required temperature corresponding to the range R22 is the second fixing temperature T2 (180° C.). However, the required temperature corresponding to the range R11 is the third fixing temperature T3 (190° C.). In the second embodiment, only one range is specified by designating the amount of decrease and the size. In the situation shown in FIG. 4, the required temperature of the paper sheet 8 is the second fixing temperature T2.

The determiner 140 determines whether the set temperature is acceptable as the required temperature. The set temperature is the first fixing temperature T1, but the required temperature is the second fixing temperature T2. Since the set temperature does not coincide with the required temperature, the determination result of the determiner 140 is negative. Therefore, the set temperature is corrected from the first fixing temperature T1 to the second fixing temperature T2. Therefore, fixing is performed for the second and subsequent paper sheets that are printed on the basis of the continuous printing command while the set temperature is maintained at the second fixing temperature T2.

The fixing device according to the second embodiment can be specify the required temperature of the paper and correct the set temperature of the paper to the required temperature. Therefore, the occurrence of improperly printed paper is suppressed. Furthermore, since the required temperatures has been set so as to correspond to the difference in the kinds in the temperature table for determination of TABLE 3, the set temperature can be corrected more appropriately.

(Variations)

The Present Invention is not Limited to the above-mentioned embodiments, but includes various modified embodiments without departing from the spirit and scope of the claims.

For the heater and the pressurizer, belts can also be used instead of the rollers.

For the pressurizer, not only a hard roller but also a soft roller having a surface layer formed of silicon rubber and PFA tube can also be used as a roller.

For the heat source, not only a halogen heater but also an electromagnetic heater can also be used.

The temperature setter 10 is not limited to have the configuration in which the set temperature can be set depending on the kind of paper. For example, the initial value of the set temperature may be set to the temperature (the first fixing temperature T1) corresponding to a predetermined kind (for example, A4 size regular paper) at all times. In this case, the temperature setter 10 is equipped with a memory for memorizing a temperature as an initial value, instead of the kind input unit 12 and the temperature table memory for setting 13.

FIG. 7 is a view showing the configuration of an image forming device equipped with the fixing device according to the first/second embodiment. The fixing device 1 according to the first or second embodiment can be applied to such a printer (image forming device) 210 as shown in FIG. 7, for example. The printer 210 forms images using a known electrophotographic method and is equipped with an operation unit 205, an image process device 211, a feeder 212, a fixing unit (fixing device 1) and a controller 214. The printer 210 is connected to a network consisting of a LAN (local area network) and so on, for example. Upon receiving a command for executing a print job from an external terminal (not shown), the printer 210 forms a color image composed of yellow, magenta, cyan and black according to the command. In the following descriptions, the reproduced colors of yellow, magenta, cyan and black are represented by Y, M, C and K, respectively, and these Y, M, C and K are attached to the numerals representing the components relating to the respective reproduced colors.

The operation unit 205 is provided with a kind input unit 12 having input keys through which the kind of paper is input by the operator.

The image process device 211 is equipped with image formers 215Y, 215M, 215C and 215K corresponding to the reproduced colors Y, M, C and K, respectively, an intermediate transfer belt 216, etc.

The image formers 215Y to 215K are equipped with photoconductive drums 217Y to 217K; chargers 218Y to 218K disposed around the photoconductive drums 217Y to 217K; exposure units 219Y to 219K; developing units 220Y to 220K; primary transfer rollers 221Y to 221K; and cleaners 222Y to 222K for cleaning the photoconductive drums 217Y to 217K; etc., so that the image formers 215Y to 215K form the toner images of the reproduced colors of Y, M, C and K on the photoconductive drums 217Y to 217K. The exposure unit 219Y is equipped with a laser diode, a polygon mirror for deflecting the laser beam emitted from this laser diode so that the surface of the photoconductive drum 217Y is exposed and scanned in the main scanning direction thereof, and a scanning lens, etc. inside the housing thereof. The other exposure units 219M to 219K have configurations similar to that of the exposure unit 219Y.

Furthermore, the intermediate transfer belt 216 constituting the image process device 211 is an endless belt stretched between a drive roller 223 and a driven roller 224 and rotated by a belt drive motor 225 in the direction indicated by the arrow.

The feeder 212 is equipped with a paper feeding cassette 226 accommodating the paper sheets 8 serving as recording sheets; a delivery roller 228 for delivering the paper sheets 8 inside the paper feeding cassette 226 onto a conveyance path 227 one by one; a pair of conveying rollers 229 for conveying the paper sheets 8 delivered; a pair of timing rollers 231 for setting the timing of feeding the paper sheets 8 to a secondary transfer position 230; and a secondary transfer roller 232 making pressure contact with the drive roller 223 with the intermediate transfer belt 216 interposed therebetween at the secondary transfer position 230.

The secondary transfer roller 232 is a conductive elastic roller produced, for example, by adding an ionic conductive substance to NBR (nitrile rubber) and by foaming the mixture. The secondary transfer roller 232 is driven by a secondary transfer roller drive motor 233 and rotated in the direction indicated by the arrow. Furthermore, the secondary transfer voltage output from a secondary transfer voltage output unit 234 is applied to the secondary transfer roller 232. As a result, an electrostatic force for secondary transfer acts between the secondary transfer roller 232 and the drive roller 223.

The fixing device 1, equipped with the heating roller 2 and the pressure roller 3, heats each paper sheet 8 at a predetermined fixing temperature and presses the paper sheet 8, thereby fixing toner images on the paper sheet 8.

The controller 214 converts an image signal transmitted from the external terminal into digital signals for the reproduced colors Y, M, C and K and generates drive signals for driving the laser diodes of the exposure units 219Y to 219K. Then, the laser diodes of the exposure units 219Y to 219K are driven by the generated drive signals, laser beams L are emitted, and the photoconductive drums 217Y to 217K are exposed and scanned.

The photoconductive drums 217Y to 217K have been charged uniformly by the chargers 218Y to 218K in advance before the exposure and scanning are performed by the exposure units 219Y to 219K. Next, electrostatic latent images are formed on the photoconductive drums 217Y to 217K by the exposure and scanning using the laser beams L from the exposure units 219Y to 219K.

Then, the electrostatic latent images are developed by toner by the developing units 220Y to 220K. The toner images obtained in this way on the photoconductive drums 217Y to 217K are primarily transferred onto the intermediate transfer belt 216 by the electrostatic force acting between the primary transfer rollers 221Y to 221K and the photoconductive drums 217Y to 217K. At that time, the timings of the imaging actions for the respective colors are shifted so that the respective toner images are overlaid and transferred at the same position of the intermediate transfer belt 216. Then, the respective color toner images overlaid and primarily transferred onto the intermediate transfer belt 216 are moved to the secondary transfer position 230 by the rotation of the intermediate transfer belt 216.

Each paper sheet 8 is fed from the feeder 212 by the pair of timing rollers 231 in exact timing with the imaging actions for the respective colors with respect to the intermediate transfer belt 216. The paper sheet 8 is conveyed while being held between the intermediate transfer belt 216 and the secondary transfer roller 232. The toner images on the intermediate transfer belt 216 are all secondarily transferred onto the paper sheet 8 by the electrostatic force acting between the secondary transfer roller 232 serving as the transfer roller and the drive roller 223.

Therefore, the paper sheet 8 having passed the secondary transfer position 230 is conveyed to the fixing device 1. In the fixing device 1, the toner images are heated and pressed, thereby fixed on the paper sheet 8. Then, the paper sheet 8 is discharged by a pair of discharging rollers 235 and accommodated in an accommodation tray 236.

As an image forming device equipped with the fixing device 1 according to the first or second embodiment, not only a printer having only the above-mentioned printing function but also a multi-functional machine having a printing function and other functions can be used. Examples of such a multi-functional machine include a copier equipped with a scanner and a machine having a facsimile function. The printing function includes monochrome printing and/or color printing.

A first aspect of the present invention provides a fixing device described below, comprising a heater; a pressurizer forming a nip section by making contact with the heater so that fixing is performed for a sheet passing through the nip section; a controller for controlling the surface temperature of the heater so that the surface temperature of the heater becomes a predetermined set temperature; an amount of decrease detector for detecting an amount of decrease in the surface temperature of the pressurizer between before and after the passing of the sheet through the nip section; a determiner for specifying a required temperature required to perform the fixing for the sheet on the basis of the amount of decrease and for determining whether the set temperature is acceptable as the required temperature; and a temperature compensator for correcting the set temperature so that the set temperature is acceptable as the required temperature in the case that the determiner has determined that the set temperature is not acceptable as the required temperature.

According to the first aspect of the present invention, the determiner comprises a correspondence table showing the correspondence between the amount of decrease and the required temperature so that the required temperature is specified.

According to the first aspect of the present invention, the fixing device further comprises a size detector for detecting the size of the sheet passing through the nip section, wherein the determiner specifies the required temperature on the basis of not only the amount of decrease but also the size of the sheet.

The determiner comprises a correspondence table showing the correspondence among the amount of decrease, the required temperature, and the size so that the required temperature is specified.

According to the first aspect of the present invention, the fixing device further comprises a kind input unit for inputting kind information relating to the basis weight and size of the sheet and a temperature setter for setting the set temperature on the basis of the kind information input.

According to the first aspect of the present invention, the fixing device further comprises a printing command detector for detecting whether a printing command is present, wherein when the printing command detector detects a continuous printing command for printing a plurality of sheets, the amount of decrease detector calculates the amount of decrease in the first sheet of the plurality of sheets that are printed on the basis of the continuous printing command.

The amount of decrease detector comprises a temperature detector for detecting the temperature of the surface of the pressurizer while making contact with the surface.

A second aspect of the present invention provides an image forming device described below, comprising a heater; a pressurizer forming a nip section by making contact with the heater so that fixing of a image is performed for the sheet passing through the nip section; a controller for controlling the surface temperature of the heater so that the surface temperature of the heater becomes a predetermined set temperature; an amount of decrease detector for detecting an amount of decrease in the surface temperature of the pressurizer between before and after the passing of the sheet through the nip section; a determiner for specifying a required temperature required to perform the fixing for the sheet on the basis of the amount of decrease and for determining whether the set temperature is acceptable as the required temperature; and a temperature compensator for correcting the set temperature so that the set temperature is acceptable as the required temperature in the case that the determiner has determined that the set temperature is not acceptable as the required temperature.

The determiner comprises a correspondence table showing the correspondence between the amount of decrease and the required temperature so that the required temperature is specified.

According to the second aspect of the present invention, the image forming device further comprises a size detector for detecting the size of the sheet passing through the nip section, wherein the determiner specifies the required temperature on the basis of not only the amount of decrease but also the size of the sheet.

According to the second aspect of the present invention, the determiner comprises a correspondence table showing the correspondence among the amount of decrease, the required temperature, and the size so that the required temperature is specified.

According to the second aspect of the present invention, the image forming device further comprises a kind input unit for inputting kind information relating to the basis weight and size of the sheet and a temperature setter for setting the set temperature on the basis of the kind information input.

According to the second aspect of the present invention, the image forming device further comprises a printing command detector for detecting whether a printing command is present, wherein when the printing command detector detects a continuous printing command for printing a plurality of sheets, the amount of decrease detector calculates the amount of decrease in the first sheet of the plurality of sheets that are printed on the basis of the continuous printing command.

The amount of decrease detector comprises a temperature detector for detecting the temperature of the surface of the pressurizer while making contact with the surface.

According to the present invention, the fixing device and/or the image forming device can specify the required temperature required for sheets and can correct the set temperature to the specified required temperature, thereby suppressing the occurrence of improperly printed paper.

The invention claimed is:

1. A fixing device comprising:

a heater, a pressurizer forming a nip section by making contact with the heater so that fixing is performed for a sheet passing through the nip section, a controller for controlling the surface temperature of the heater so that the surface temperature of the heater becomes a predetermined set temperature, an amount of decrease detector for detecting an amount of decrease in the surface temperature of the pressurizer between before and after the passing of the sheet through the nip section, a determiner for specifying a required temperature required to perform the fixing for the sheet on the basis of the amount of decrease and for determining whether the set temperature is acceptable as the required temperature, and a temperature compensator for correcting the set temperature so that the set temperature is acceptable as the required temperature in the case that the determiner has determined that the set temperature is not acceptable as the required temperature.

2. The fixing device according to claim 1, wherein the determiner comprises a correspondence table showing the correspondence between the amount of decrease and the required temperature so that the required temperature is specified.

3. The fixing device according to claim 1, further comprising a size detector for detecting the size of the sheet passing through the nip section, wherein the determiner specifies the required temperature on the basis of not only the amount of decrease but also the size of the sheet.

4. The fixing device according to claim 3, wherein the determiner comprises a correspondence table showing the correspondence among the amount of decrease, the required temperature, and the size so that the required temperature is specified.

5. The fixing device according to claim 1, further comprising:

a kind input unit for inputting kind information relating to the basis weight and size of the sheet, and a temperature setter for setting the set temperature on the basis of the kind information input.

6. The fixing device according to claim 1, further comprising a printing command detector for detecting whether a printing command is present, wherein when the printing command detector detects a continuous printing command for printing a plurality of sheets, the amount of decrease detector calculates the amount of decrease in the first sheet of the plurality of sheets that are printed on the basis of the continuous printing command.

7. The fixing device according to claim 1, wherein the amount of decrease detector comprises a temperature detector for detecting the temperature of the surface of the pressurizer while making contact with the surface.

8. An image forming device comprising:

a heater, a pressurizer forming a nip section by making contact with the heater so that fixing of a image is performed for the sheet passing through the nip section, a controller for controlling the surface temperature of the heater so that the surface temperature of the heater becomes a predetermined set temperature, an amount of decrease detector for detecting an amount of decrease in the surface temperature of the pressurizer between before and after the passing of the sheet through the nip section, a determiner for specifying a required temperature required to perform the fixing for the sheet on the basis of the amount of decrease and for determining whether the set temperature is acceptable as the required temperature, and a temperature compensator for correcting the set temperature so that the set temperature is acceptable as the required temperature in the case that the determiner has determined that the set temperature is not acceptable as the required temperature.

9. The image forming device according to claim 8, wherein the determiner comprises a correspondence table showing the correspondence between the amount of decrease and the required temperature so that the required temperature is specified.

10. The image forming device according to claim 8, further comprising a size detector for detecting the size of the sheet passing through the nip section, wherein the determiner specifies the required temperature on the basis of not only the amount of decrease but also the size of the sheet.

11. The image forming device according to claim 10, wherein the determiner comprises a correspondence table showing the correspondence among the amount of decrease, the required temperature, and the size so that the required temperature is specified.

12. The image forming device according to claim 8, further comprising:

a kind input unit for inputting kind information relating to the basis weight and size of the sheet, and a temperature setter for setting the set temperature on the basis of the kind information input.

13. The image forming device according to claim 8, further comprising a printing command detector for detecting whether a printing command is present, wherein when the printing command detector detects a continuous printing command for printing a plurality of sheets, the amount of decrease detector calculates the amount of decrease in the first sheet of the plurality of sheets that are printed on the basis of the continuous printing command.

14. The image forming device according to claim 8, wherein the amount of decrease detector comprises a temperature detector for detecting the temperature of the surface of the pressurizer while making contact with the surface.

* * * * *